US010720098B2

(12) United States Patent
Valentine

(10) Patent No.: US 10,720,098 B2
(45) Date of Patent: Jul. 21, 2020

(54) PULSE-WIDTH-MODULATION CONTROL OF MICRO LED

(71) Applicant: Facebook Technologies, LLC, Menlo Park, CA (US)

(72) Inventor: Gareth John Valentine, York (GB)

(73) Assignee: Facebook Technologies, LLC, Menlo Park, CA (US)

( * ) Notice: Subject to any disclaimer, the term of this patent is extended or adjusted under 35 U.S.C. 154(b) by 37 days.

(21) Appl. No.: 15/814,341

(22) Filed: Nov. 15, 2017

(65) Prior Publication Data

US 2019/0147793 A1 May 16, 2019

(51) Int. Cl.

| | |
|---|---|
| ***G09G 3/20*** | (2006.01) |
| ***G09G 3/32*** | (2016.01) |
| ***G09G 3/3233*** | (2016.01) |
| ***G09G 3/36*** | (2006.01) |
| ***G09G 3/3208*** | (2016.01) |
| *G09G 3/3241* | (2016.01) |

(52) U.S. Cl.

CPC ..... *G09G 3/32* (2013.01); *G09G 3/2014* (2013.01); *G09G 3/3208* (2013.01); *G09G 3/3233* (2013.01); *G09G 3/3611* (2013.01); *G09G 3/2088* (2013.01); *G09G 3/3241* (2013.01); *G09G 2300/0408* (2013.01); *G09G 2300/08* (2013.01); *G09G 2300/0804* (2013.01); *G09G 2300/0814* (2013.01); *G09G 2300/0857* (2013.01); *G09G 2310/08* (2013.01); *G09G 2320/064* (2013.01)

(58) Field of Classification Search

CPC ..... G09G 3/2014; G09G 3/2018; G09G 3/32; G09G 3/3241; G09G 3/3233; G09G 3/3611; G09G 3/3648; G09G 2300/0408; G09G 2300/08; G09G 2300/0804; G09G 2300/0857; G09G 2310/0286; G09G 2310/0297; G09G 2310/08; G09G 2320/064; G09G 2320/0238; G09G 2360/145; H01L 33/06; H01L 33/08; H01L 2924/12041

See application file for complete search history.

(56) References Cited

U.S. PATENT DOCUMENTS

| | | | | |
|---|---|---|---|---|
| 3,740,570 | A * | 6/1973 | Kaelin | G09G 3/32 307/40 |
| 3,909,788 | A * | 9/1975 | Kaelin | G09G 3/32 345/83 |
| 8,754,425 | B2 * | 6/2014 | Anderson | H01L 27/156 257/88 |
| 10,181,495 | B1 * | 1/2019 | Schubert | H01L 27/156 |
| 10,283,037 | B1 * | 5/2019 | Far | G09G 3/2011 |
| 10,424,614 | B2 * | 9/2019 | Schubert | C25F 3/14 |

(Continued)

*Primary Examiner* — Michael J Eurice

(74) *Attorney, Agent, or Firm* — Fenwick & West LLP

(57) ABSTRACT

Embodiments relate to a micro light-emitting-diode (mLED) cell that includes a mLED and a controller. The controller receives a brightness data signal and generates a driving signal corresponding to the brightness data signal. The controller is coupled to the mLED for providing the driving signal that turns on the mLED for first times and turns off the mLED for second times for a duration of a cycle. The driving signal causes a current density in mLED to be above a threshold value when the mLED is turned on.

18 Claims, 9 Drawing Sheets

(56) References Cited

U.S. PATENT DOCUMENTS

2008/0174545 A1* 7/2008 Ezaki ..... G09G 3/3406 345/102
2009/0121750 A1* 5/2009 Tanaka ..... G05F 3/262 327/108
2011/0156616 A1* 6/2011 Anderson ..... B41J 2/45 315/312
2011/0157111 A1* 6/2011 Lee ..... G09G 3/3406 345/205
2012/0206421 A1* 8/2012 Cok ..... G09G 3/2085 345/204
2012/0206499 A1* 8/2012 Cok ..... G09G 3/3208 345/690
2014/0209945 A1* 7/2014 Baldridge ..... H01L 25/0753 257/91
2014/0218414 A1* 8/2014 Kikuchi ..... G09G 3/3233 345/690
2014/0264396 A1* 9/2014 Lowenthal ..... H01L 33/08 257/88
2015/0296162 A1* 10/2015 Kurokawa ..... H04N 5/3741 250/208.1
2015/0356930 A1* 12/2015 Kuranaga ..... G09G 3/3453 345/85
2015/0371585 A1* 12/2015 Bower ..... G09G 3/32 345/1.1
2016/0014362 A1* 1/2016 Kurokawa ..... H01L 27/14609 348/297
2016/0179453 A1* 6/2016 Jepsen ..... G06F 3/1446 345/690
2016/0231083 A1* 8/2016 Regan ..... F41G 1/38
2016/0353539 A1* 12/2016 Li ..... H05B 33/086
2016/0372514 A1* 12/2016 Chang ..... H01L 27/1259
2017/0018215 A1* 1/2017 Black ..... G09G 3/02
2017/0054029 A1* 2/2017 Koezuka ..... H01L 21/02557
2017/0061867 A1* 3/2017 Cok ..... G09G 3/3208
2017/0090194 A1* 3/2017 Hayes ..... G02B 27/0101
2017/0104089 A1* 4/2017 Koezuka ..... H01L 21/0217
2017/0133550 A1* 5/2017 Schuele ..... H01L 33/0079
2017/0186356 A1* 6/2017 Cok ..... G09G 3/2014
2017/0187976 A1* 6/2017 Cok ..... H04N 5/376
2017/0199604 A1* 7/2017 Lin ..... G02F 1/133603
2017/0271557 A1* 9/2017 Brennan ..... H01L 33/20
2017/0330509 A1* 11/2017 Cok ..... G09G 3/2014
2018/0075814 A1* 3/2018 Parikh ..... G09G 3/3622
2018/0113564 A1* 4/2018 Takahashi ..... G06F 3/0416
2018/0144674 A1* 5/2018 Gupta ..... G09G 3/3233
2018/0144687 A1* 5/2018 Lin ..... G09G 3/3258
2018/0158173 A1* 6/2018 Gao ..... G06T 5/009
2018/0166607 A1* 6/2018 Wu ..... H01L 33/20
2018/0182279 A1* 6/2018 Sakariya ..... G09G 3/2014
2018/0182286 A1* 6/2018 Ahmed ..... G09G 3/3283
2018/0182294 A1* 6/2018 Radhakrishnan .... G09G 3/3241
2018/0182295 A1* 6/2018 Ahmed ..... G09G 3/3241
2018/0191978 A1* 7/2018 Cok ..... G09G 3/3208
2018/0193663 A1* 7/2018 Deligianni ..... A61N 5/0622
2018/0197471 A1* 7/2018 Rotzoll ..... G09G 3/2007
2018/0211620 A1* 7/2018 Kurokawa ..... G09G 3/3688
2018/0233537 A1* 8/2018 Liu ..... H01L 27/156
2018/0240409 A1* 8/2018 Li ..... G09G 3/3283
2018/0247584 A1* 8/2018 Chen ..... G09G 3/32
2018/0323180 A1* 11/2018 Cok ..... G09G 3/2014
2018/0348524 A1* 12/2018 Blum ..... G02B 27/0172
2018/0348529 A1* 12/2018 Blum ..... G02B 27/0176
2018/0357948 A1* 12/2018 Chen ..... G09G 3/32
2018/0374829 A1* 12/2018 Henley ..... H01L 21/78
2019/0006559 A1* 1/2019 Lai ..... H01L 33/38
2019/0096325 A1* 3/2019 Miyasaka ..... G09G 3/3233
2019/0107719 A1* 4/2019 Edwin ..... G02B 27/0172
2019/0110344 A1* 4/2019 Lo ..... H05B 33/0821
2019/0198562 A1* 6/2019 Schubert ..... H01L 21/308
2019/0237001 A1* 8/2019 Lin ..... G09G 3/2044
2019/0296188 A1* 9/2019 Lai ..... H01L 33/382

* cited by examiner

PULSE-WIDTH-MODULATION CONTROL OF MICRO LED

BACKGROUND OF THE INVENTION

1. Field of the Disclosure

The present disclosure relates to controlling the brightness of micro light emitting diodes (mLEDs) and more specifically to using a digital pulse-width-modulation (PWM) control scheme for controlling the brightness of mLEDs.

2. Description of the Related Art

Micro light-emitting diode (mLED) display are an emerging flat panel display technology that includes microscopic light-emitting diodes (LEDs) for displaying images. Compared to liquid crystal display (LCD) technology, mLED display devices offer improved contrast, faster response time, and lower energy consumption.

mLEDs are self-emitting elements that generate light in response to a forward bias current that is provided to the diode. The amount of light emitted by the mLED increases as the amount of current supplied to the mLED increases. In some implementations, mLEDs are driven using a voltage controlled current source which generates a driving current that increases with the increase in the voltage level of a voltage signal. The voltage signal may in turn be generated based on a data signal that specifies the desired brightness of the mLED.

SUMMARY

Embodiments relate to a micro light-emitting-diode (mLED) cell that includes a mLED and a controller. The controller receives a brightness data signal and generates a driving signal corresponding to the brightness data signal. The controller is coupled to the mLED for providing the driving signal that turns on the mLED for first times and turns off the mLED for second times for a duration of a cycle. The driving signal causes a current density in mLED to be above a threshold value when the mLED is turned on.

Other embodiments relate to a micro light-emitting-diode (mLED) cell that includes a controller, a current source, and a mLED. The controller generates a driving signal having a set amplitude and a duty cycle proportional to a brightness data signal. The current source is coupled to an output of the controller and generates a driving current based on the driving signal generated by the controller. The average amplitude of the driving current is proportional to the brightness data signal. The mLED is coupled to the current source and emits light with an average brightness that is proportional to the driving current.

Other embodiments relate to a mLED cell that includes a memory, multiple AND gates, a current source, and a mLED. The memory includes multiple memory cells and multiple memory output, each memory output corresponding to an output of a memory cell. The memory stores a brightness data value. Each AND gate is coupled to a memory output and a periodic pulse signal. The current source is coupled to the output of each of the AND gates and generates a driving current based on the outputs of each of the AND gates. The mLED is coupled to the current source and emits light with an average brightness that is proportional to the driving current.

In one or more embodiments, the memory of the mLED cell includes one memory cell for each bit of the brightness data value. Furthermore, the mLED cell includes circuitry to implement one AND gate logic function for each bit of the brightness data value. In this embodiment, the output of one memory cell is coupled to an input of an AND gate and an input of a next memory cell. The mLED cell further receives multiple periodic pulse signals. Each periodic pulse signal coupled to an input of an AND gate.

BRIEF DESCRIPTION OF THE DRAWINGS

The teachings of the embodiments can be readily understood by considering the following detailed description in conjunction with the accompanying drawings.

DETAILED DESCRIPTION OF EMBODIMENTS

The Figures (FIG.) and the following description relate to preferred embodiments by way of illustration only. It should be noted that from the following discussion, alternative embodiments of the structures and methods disclosed herein will be readily recognized as viable alternatives that may be employed without departing from the principles of the embodiments.

Reference will now be made in detail to several embodiments, examples of which are illustrated in the accompanying figures. It is noted that wherever practicable, similar or like reference numbers may be used in the figures and may indicate similar or like functionality. The figures depict embodiments for purposes of illustration only.

Embodiments relate to a control scheme for controlling the brightness of a micro light-emitting-diode (mLED or μLED) while increasing the efficiency of the mLED by using a digital pulse-width-modulation (PWM) control scheme. During on-times of the PWM scheme, the current density in mLED exceeds a threshold level corresponding to an internal quantum efficiency (IQE) that is higher than a threshold efficiency. The current density of the mLED during the on-times of the PWM is higher than the current density of conventional macro LEDs. The off-times of the PWM scheme is controlled so that the average brightness of the mLED reaches the desired level.

Figure 1A:
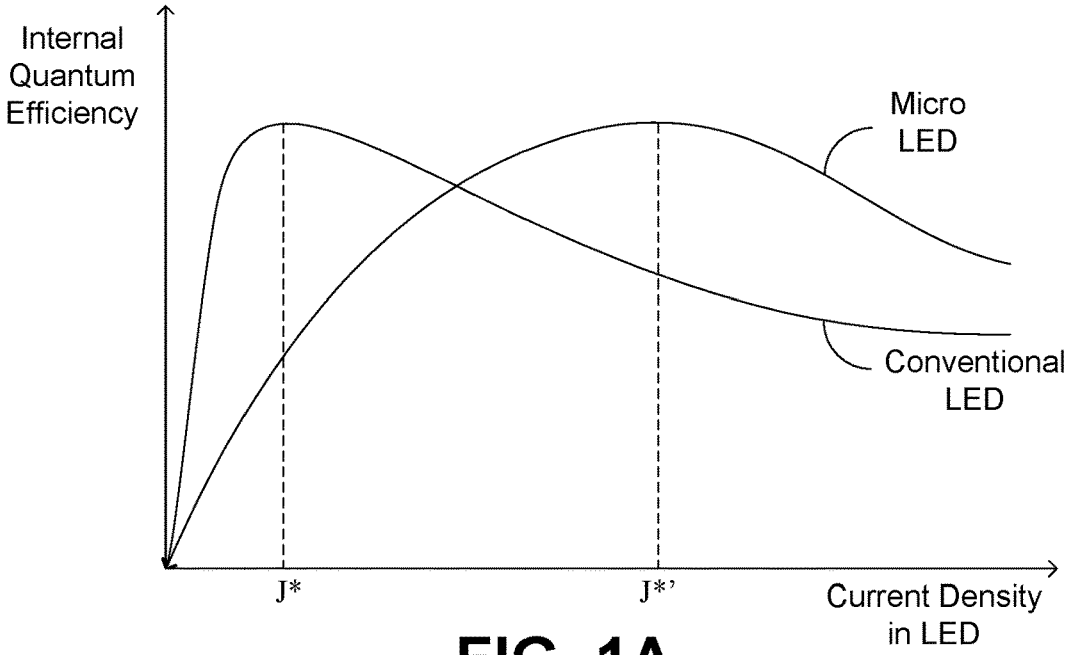
FIG. 1A illustrates a graph showing the internal quantum efficiency with respect to the current density for a conventional LED and a micro LED (mLED).

The internal quantum efficiency (IQE) of light-emitting-diodes (LEDs) changes as a function of the current density in the LED. FIG. 1A illustrates a graph showing the IQE with respect to the current density for a conventional macro LED and a micro LED (mLED). As shown in FIG. 1A, the conventional LEDs reach a peak IQE at a lower current density J* compared to the peak IQE J*' of mLEDs. As such, conventional LEDs quickly reach an efficient light generation value, even for low current density values. In contrast, mLEDs may have poor IQE when operated at low current density values. That is, since the brightness of a mLED is proportional to the current density used to drive the mLED, compared to conventional LEDs, mLEDs are inefficient at low luminance values if driven at constant current.

Figure 1B:
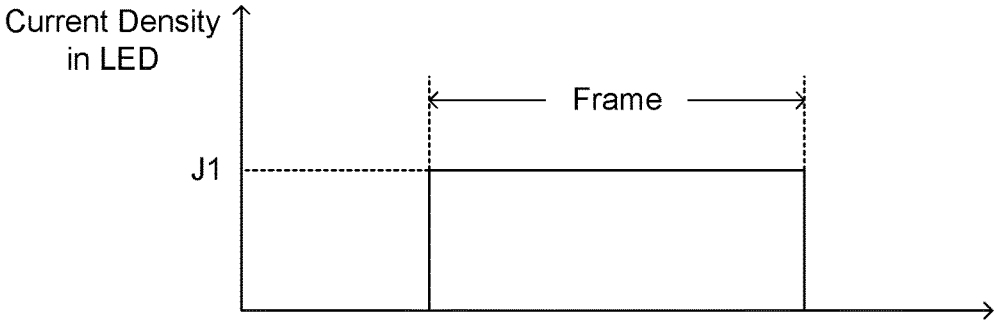
FIG. 1B illustrates a timing diagram when driving an LED with a constant current.

FIG. 1B illustrates a timing diagram when driving an LED with a constant current. Using the driving scheme of FIG. 1B, the mLED is driven with a current J1 that is related to the desired brightness of the mLED. The current J1 is then supplied to the mLED through out the duration of a cycle (e.g., $1/60^{th}$ of a second). As such, the current used to drive the mLED will vary based on the desired brightness. As such, the IQE of the mLED will also vary based on the desired brightness of the mLED. As the brightness of the mLED drops, the current density in mLED drops further from J*', causing a decrease in the IQE of the mLED. Furthermore, since the mLED is constantly being driven, and thus, emitting light, the mLED may not have time to cool down.

Figure 1C:
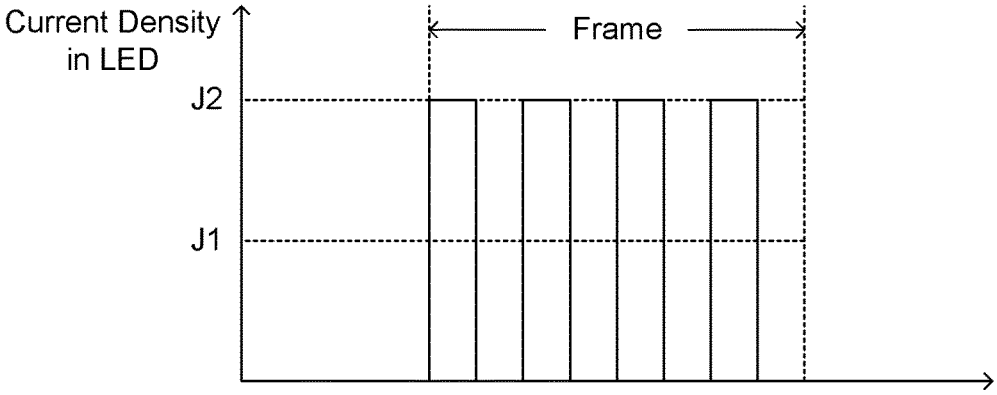
FIG. 1C illustrates a timing diagram for driving an mLED, according to one embodiment.

FIG. 1C illustrates a timing diagram for driving a mLED, according to one embodiment. Using the driving scheme of FIG. 1C, the mLED is driven with a preset current J2. The perceived brightness of the mLED is then controlled by the amount of time the mLED is driven. That is, if a lower brightness is desired, the mLED is driven during a shorter amount of time within one cycle, and if a higher brightness is desired, the mLED is driven during a longer amount of time within one cycle. In the example of FIG. 1C, since the mLED is driven with the current J2 for half of the duration of the cycle, the perceived brightness of the mLED will be half of the brightness of the mLED when the mLED is driven with current J2. Since during the period of time the mLED is being driven, the mLED is supplied the same preset current where the current density in the mLED is above a threshold value $J_{TH}$ closer to J*' (see FIG. 1A), the IQE of the mLED can be better controlled. That is, the current J2 may be selected to so that the mLED operates with current density closer to J*' and achieving a higher IQE.

Figure 2A:
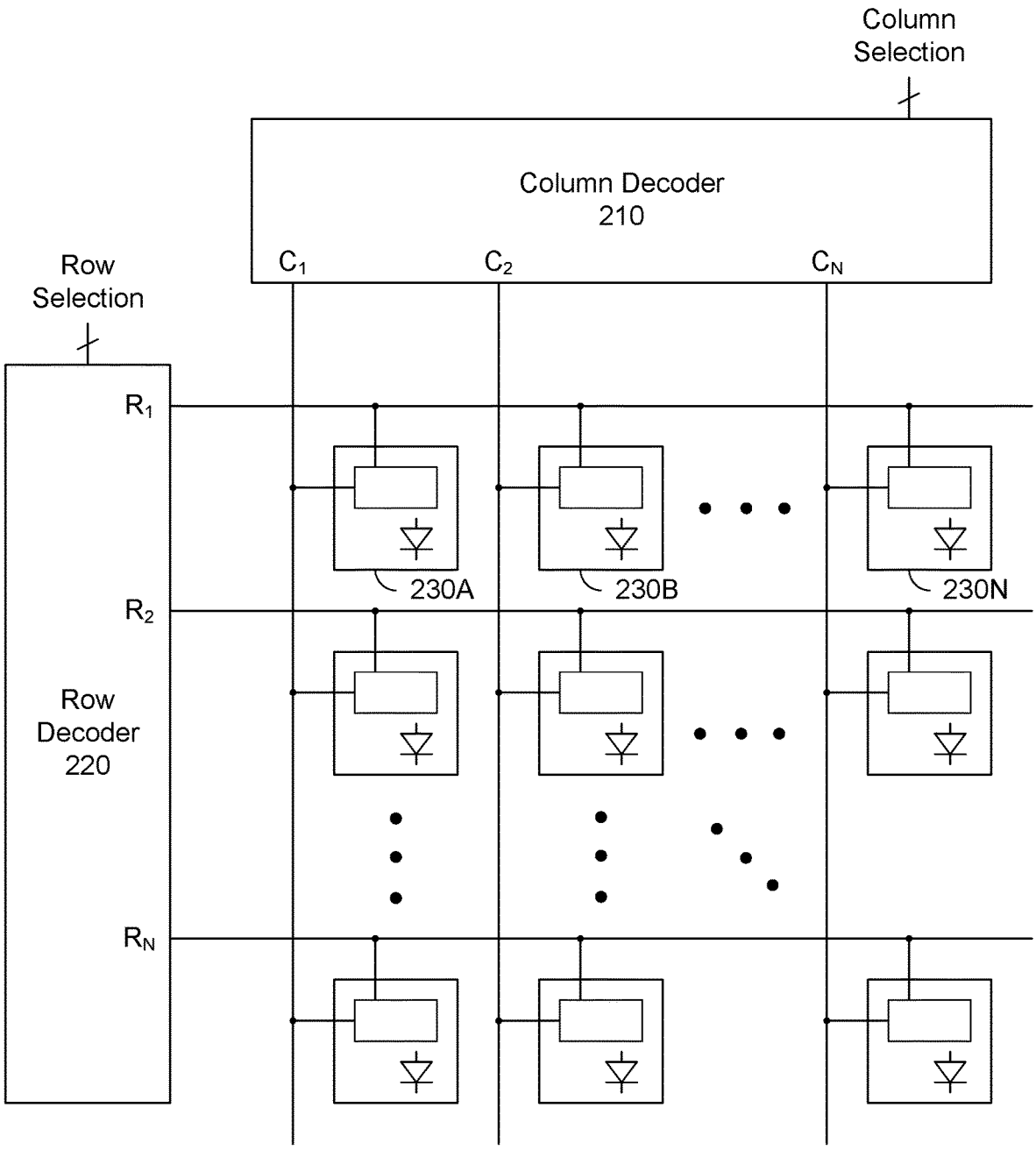
FIG. 2A illustrates a block diagram of a mLED display panel, according to one embodiment.

FIG. 2A illustrates a block diagram of a mLED display panel, according to one embodiment. The mLED display panel may include, among other components, a column decoder 210, a row decoder 220, and multiple mLED cells 230. The column decoder 210 selects or asserts one column of mLED cells of the display panel based on a column selection signal. In one embodiment, the column selection signal is generated by an n-bit counter. In this embodiment, the column selection decoder may be an n to $2^n$ decoder.

The row decoder 220 selects or asserts one row of mLED cells of the display panel based on a row selection signal. In some embodiments, the row selection signal is generated by an m-bit counter. In this embodiment, the row selection decoder may be an m to $2^m$ decoder.

The multiple mLED cells 230 are arranged in a grid pattern. In some embodiments, the mLED cells are arranged in other patterns, such as, a circular pattern, an oval pattern. Each mLED cell of the display panel is coupled to one output of the column decoder 210 and one output of the row decoder 220. As such, a specific mLED cell may be addressed by asserting a specific output of the column decoder 210 and a specific output of the row decoder 220. For instance, mLED cell 230A is addressed by asserting column decoder output $C_1$ and row decoder output $R_1$, mLED cell 230B is addressed by asserting column decoder output $C_2$ and row decoder output $R_1$, mLED cell 230N is addressed by asserting column decoder output $C_N$ and row decoder output $R_1$, and so forth.

To increase the efficiency of the mLED display panel, the mLEDs are driven with a current density that is larger than a threshold value. In some embodiments, the threshold value is 300 A/cm$^2$. If a low luminance value is desired (e.g, in a dark scene of a video), instead of driving the mLED with a lower current density, the mLED is driven for a shorter amount of time, or using shorter emission bursts using the PWM scheme as described above with reference to FIG. 1C.

Figure 2B:
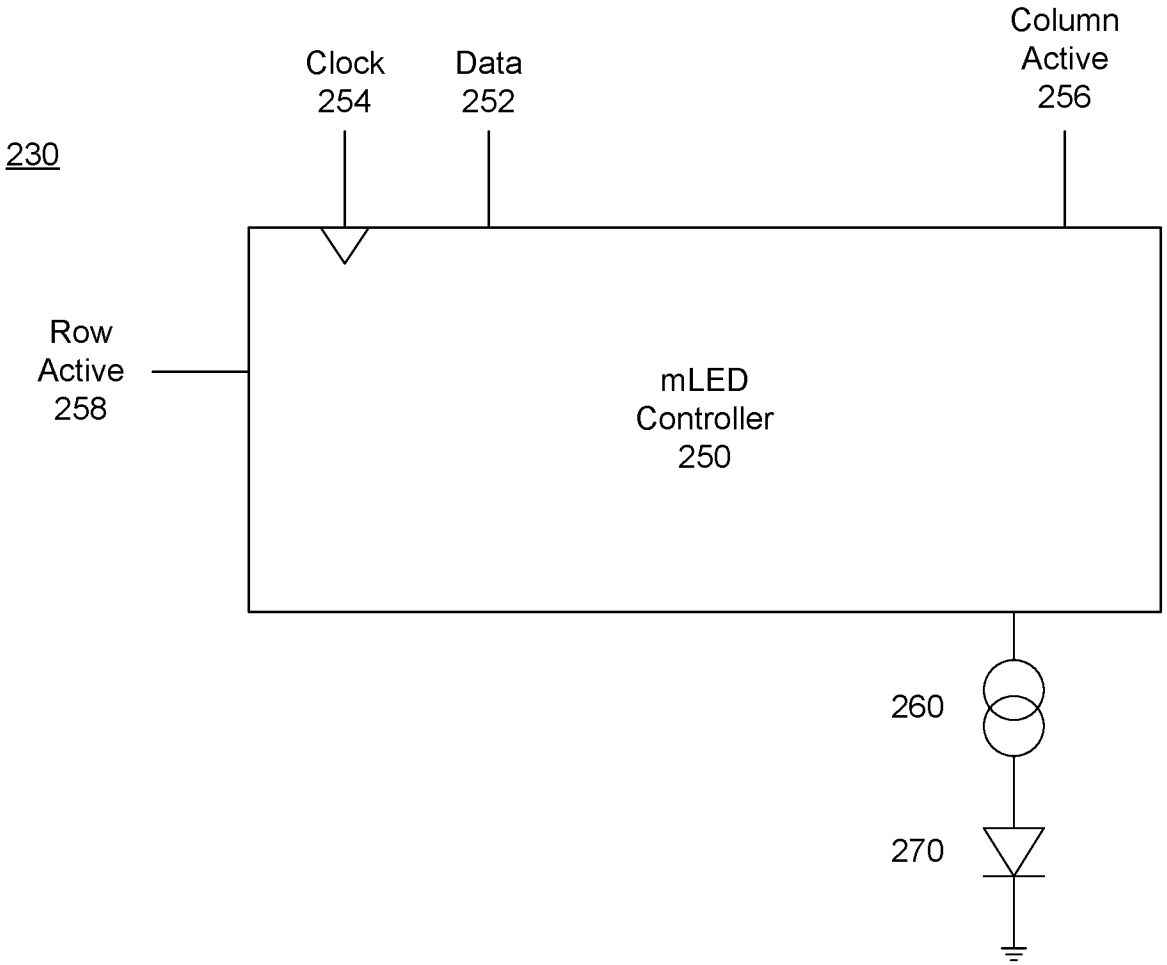
FIG. 2B illustrates a block diagram of a mLED cell, according to one embodiment.

FIG. 2B illustrates a block diagram of a mLED cell 230, according to one embodiment. The mLED cell 230 includes a mLED controller 250, a current source 260, and a mLED 270. The mLED controller 250 receives as an input a data signal 252, a column active signal 256, a row active signal 258, and a clock 254. The mLED controller 250 stores the data signal 252 that is synchronized to the clock 254 when the column active signal 256 and the row active signal 258 are both asserted. In some embodiments, the mLED controller 250 is configured to receive a single active signal and stores the data signal 252 when the active signal is asserted. The mLED controller 250 then generates a driving signal based on the stored data signal. The driving signal generated by the mLED controller 250 has a set voltage amplitude and a duty cycle that is based on the value of the data signal. In some embodiments, the duty cycle of the driving signal increases as the value of the data signal 252 increases. In one embodiment, the duty cycle of the driving signal is proportional to the value of the data signal 252.

The current source 260 receives the driving signal and generates a driving current for driving the mLED 270. In some embodiments, the current source 260 includes a driving transistor that turns on or off based on the driving signal received from the mLED controller 250. In this embodiment, a gate terminal of the driving transistor is controlled by the driving signal, a drain terminal of the driving transistor is coupled to a power supply voltage, and the source terminal of the driving transistor is coupled to the mLED. In some embodiments, the amplitude of the driving current is chosen so that the current density of mLED is equal or substantially equal to J*'. In other embodiments, the amplitude of the driving signal is chosen so that the current density of the mLED is greater than J*'. The mLED 270 then receives the driving current and emits light accordingly.

Figure 3A:
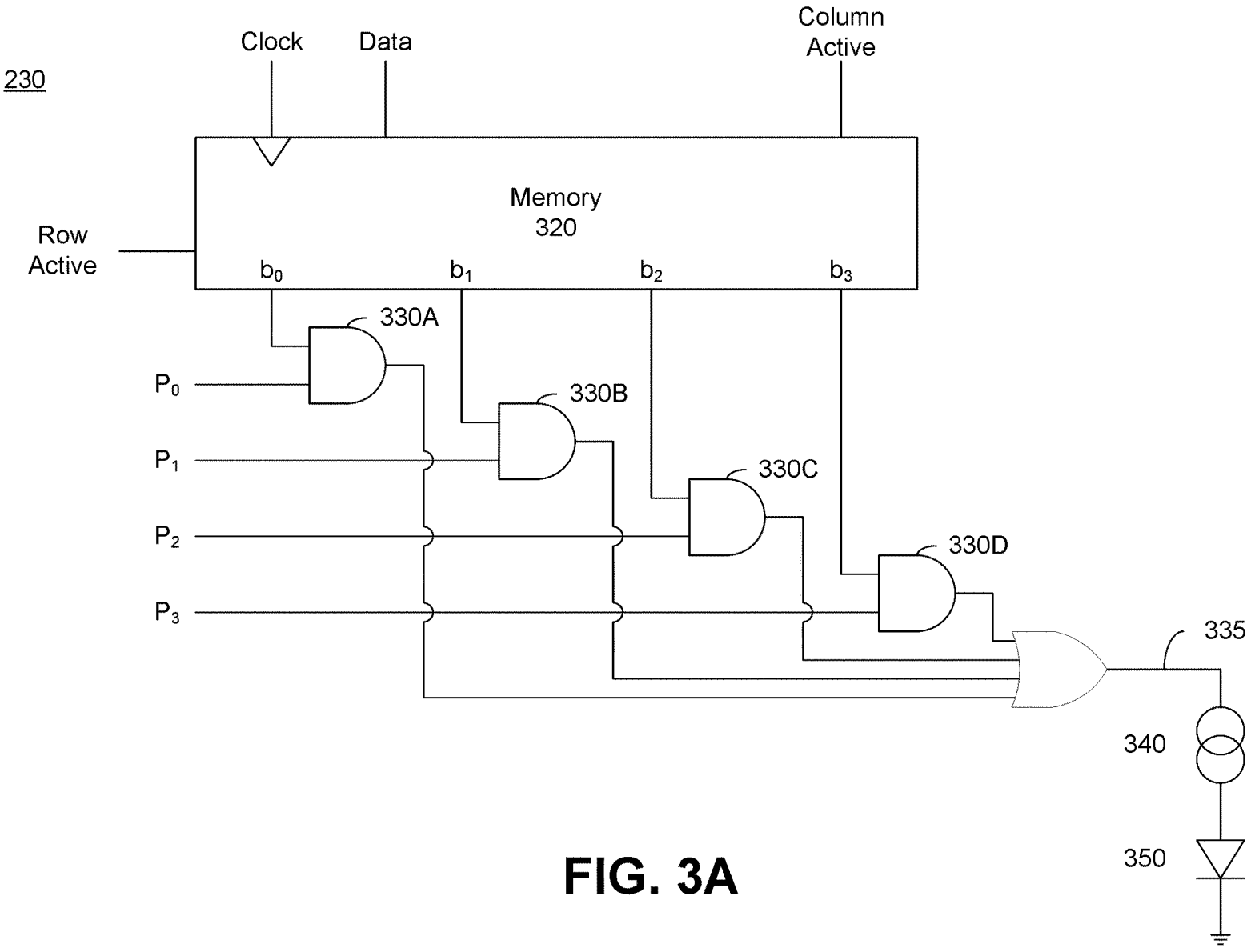
FIG. 3A illustrates a circuit diagram of a mLED cell, according to one embodiment.

FIG. 3A illustrates a circuit diagram of a mLED cell 230, according to one embodiment. mLED 230 may include, among other components, a memory 320, multiple AND gates 330A through 330D, a current source 340 and a mLED 350. As used herein, an AND gate is a logic gate that receives at least two inputs and produces one output. In some embodiments, the AND gate only has one of a pull up network or a pull down network. For instance, the AND gate may have a pull up network that sets a high level output when both inputs are high, but has a floating output (e.g., a high impedance output) when one of the inputs are low. In the embodiments where the AND gates only have one of a pull up network or a pull down network, an OR gate that combines the output of the AND gates may be obviated. The output of the AND gate has a high level (HI) when the voltage level for both outputs are above a threshold value, and has a low level (LO) when the voltage level of at least one input is below the threshold value. The memory 320 includes storage elements (not shown) that stores a digital value indicative of a desired brightness for the mLED 350 of the mLED cell 230. The memory 320 of FIG. 3 stores four-bit values that are indicative of the desired brightness of the mLED 350. In some embodiments, memory 320 may larger values (i.e., values with deeper bit depth), such as 8-bit values or 10-bit values. The memory 320 further includes multiple outputs. In some embodiments, the memory 320 includes the same number of outputs as the bit depth of the value stored by the storage elements of the memory 320.

Figure 3B:
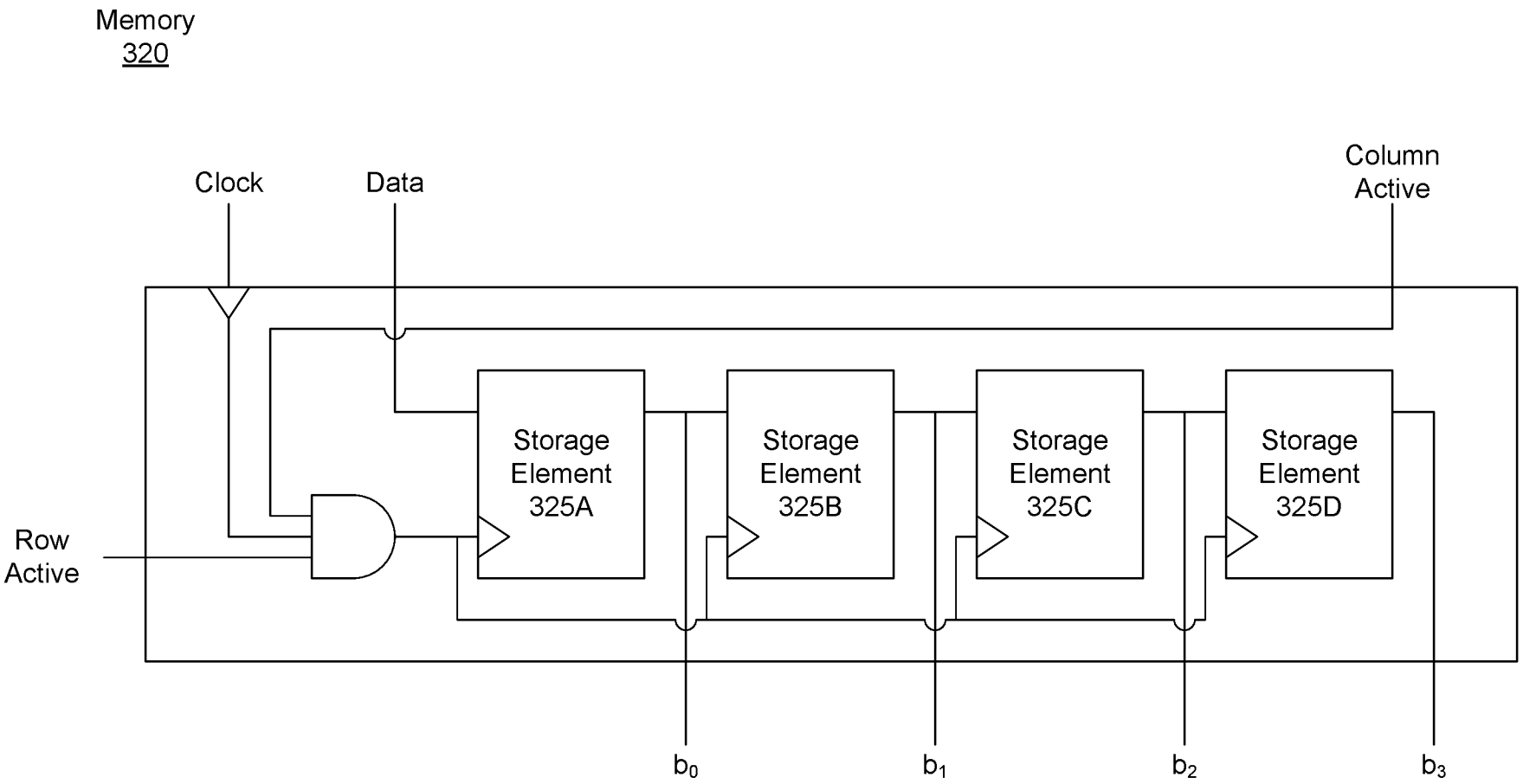
FIG. 3B illustrates a detailed diagram of the memory of the mLED cell of FIG. 3A, according to one embodiment.

FIG. 3B illustrates a detailed diagram of the memory 320, according to one embodiment. The memory 320 includes multiple storage elements 320. In the embodiment of FIG. 3B, the memory 320 includes four storage elements, and thus, stores a 4-bit value. As such, a mLED cell including the memory 320 of FIG. 3B may have a brightness depth of 4-bits (i.e., 16 different levels of brightness). In other embodiments, the memory 320 may include more storage elements to increase the brightness depth of the mLED cell. For instance, a mLED cell with a brightness depth of 8-bits may include a memory 320 with 8 storage elements. In some embodiments, the memory 320 is dynamic in nature with simplified circuitry since the information stored in the memory 320 is only stored for the duration of one frame period.

The memory 320 of FIG. 3B further includes four outputs $b_0$, $b_1$, $b_2$, and $b_3$. Each of the outputs $b_0$ through $b_3$ corresponds to the output of a storage element 325. That is, output $b_0$ corresponds to the output of storage element 325A, output $b_1$ corresponds to the output of storage element 325B, output $b_2$ corresponds to the output of storage element 325C, and output $b_3$ corresponds to the output storage element 325D. In embodiments with larger bit depth, memory 320 includes more outputs, each output corresponding to one bit of the value stored by the storage elements 325.

The memory 320 further includes a data input to serially input the value to be stored in the storage elements 325. In some embodiments, the memory instead includes multiple data inputs to provide the value to be stored in the storage elements 325 in parallel. The memory 325 further includes a clock input, a column active input, and a row active input. The memory 320 stores the value provided through the data input when the column active input and the row active input are both asserted and a clock signal is provided through the clock input. In some embodiments, the storage elements store data on a positive edge of the clock signal. In other embodiments, the storage elements store data on a negative edge of the clock signal. In the embodiment of FIG. 3B the clock input, the column active input and the row active input are combined using an AND gate. Thus, the clock signal provided through the clock input is only propagated to the storage elements when the column active input and the row active inputs are both asserted.

Referring back to FIG. 3A, each output of the memory 320 is coupled to an AND gate 330. Each gate 330 is further coupled to a pulse signal P. That is, AND gate 330A is coupled to memory output $b_0$ and pulse signal $P_0$, AND gate 330B is coupled to memory output $b_1$ and pulse signal $P_1$, AND gate 330C is coupled to memory output $b_2$ and pulse signal $P_2$, and AND gate 330D is coupled to memory output $b_3$ and pulse signal $P_3$. mLED cells with larger brightness depth levels may include additional AND gates 330 and may receive additional pulse signals P.

The AND gates 330 shown in FIG. 3A are logic gates with only pull up networks. That is, instead of having pull down networks, the AND gates 330 have a high impedance output when one of the inputs have a low level.

In some embodiments, the AND functionality is incorporated directly in the memory cell. That is, the output of each storage element 325 has a high impedance output unless an "output select" line of the storage element 325 is addressed. In this embodiment, the pulse signals $P_0$ through $P_3$ are provided to the "output select" line of respective storage elements 325A thorough 325D.

Figure 4A:
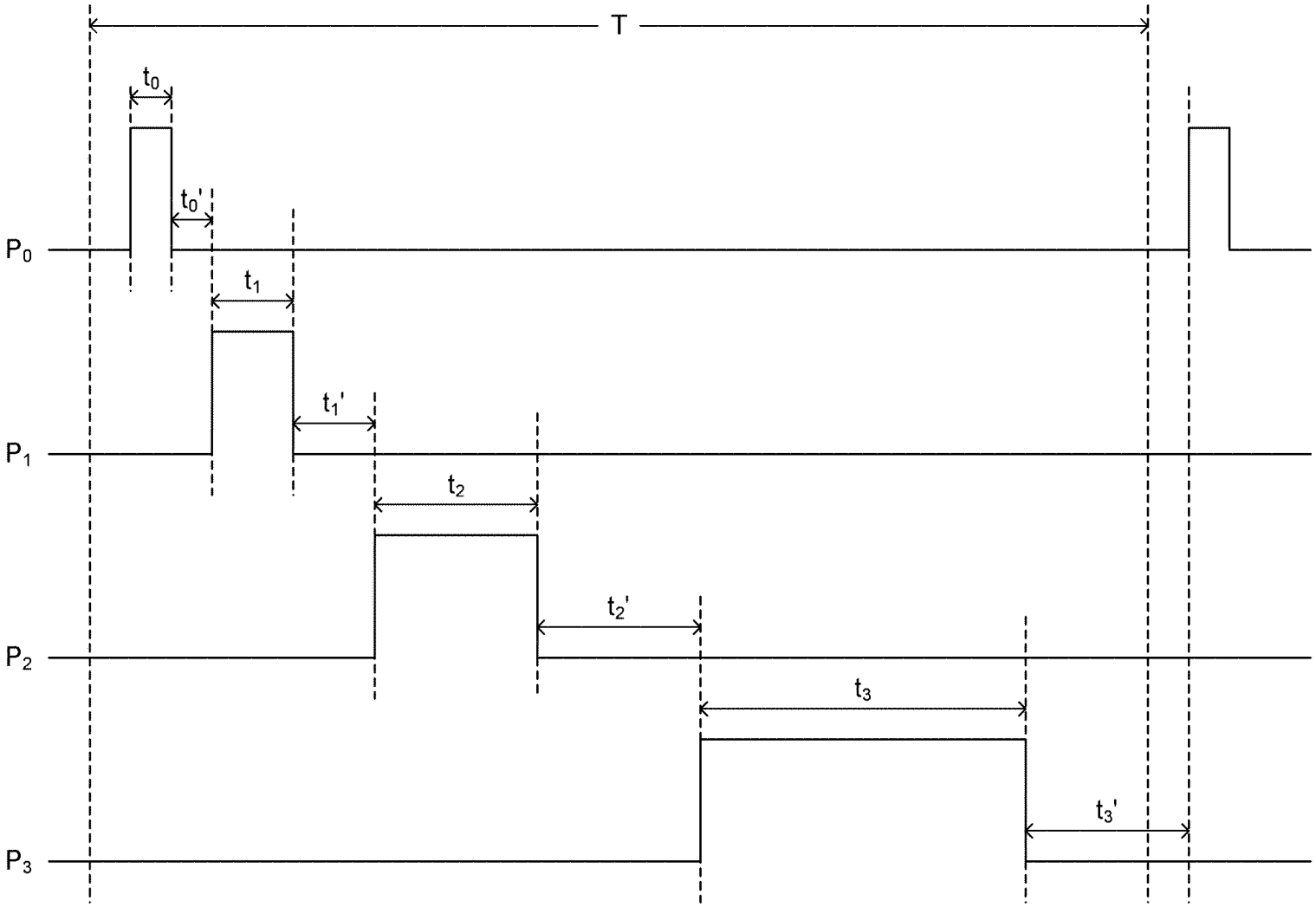
FIG. 4A illustrates a timing diagram for the waveform of one cycle of pulse signals $P_1$ through $P_4$, according to one embodiment.

FIG. 4A illustrates a timing diagram for the waveform of one cycle of pulse signals $P_0$ through $P_3$, according to one embodiment. In the timing diagram of FIG. 4A, the horizontal axis represents time, and the vertical axis represents voltage of the pulse signals. The pulses of pulse signal $P_0$ have a duration of $t_0$. That is, the time between the rising edge of pulse signal $P_0$ and the falling edge of pulse signal $P_0$ is equal to $t_0$. The pulses of pulse signal $P_1$ have a duration of $t_1$ and starts after a delay of $t_0'$ after the falling edge of pulse signal $P_0$. That is, the time between the raising edge of pulse signal $P_1$ and the falling edge of pulse signal $P_1$ is equal to $t_1$, and the time between the falling edge of pulse signal $P_0$ and the rising edge of pulse signal $P_1$ is $t_0'$. The duration $t_1$ of pulse signal $P_1$ is two times the duration to of pulse signal $P_0$. The pulses of pulse signal $P_2$ have a duration of $t_2$ and starts after a delay of $t_1'$ after the falling edge of pulse signal $P_1$. That is, the time between the raising edge of pulse signal $P_2$ and the falling edge of pulse signal $P_2$ is equal to $t_2$, and the time between the falling edge of pulse signal $P_1$ and the rising edge of pulse signal $P_2$ is $t_1'$ The duration $t_2$ of pulse signal $P_2$ is two times the duration $t_1$ of pulse signal $P_1$, or four times the duration $t_0$ of pulse signal $P_0$. The pulses of pulse single $P_3$ have a duration of $t_3$ and starts after a delay of $t_2'$ after the falling edge of pulse signal $P_2$. That is, the time between the raising edge of pulse signal $P_3$ and the falling edge of pulse signal $P_3$ is equal to $t_3$, and the time between the falling edge of pulse signal $P_2$ and the rising edge of pulse signal $P_3$ is $t_2'$. The duration $t_3$ of pulse single $P_3$ is two times the duration $t_0$ of pulse signal $P_2$, or eight times the duration to of pulse signal $P_0$. Furthermore, the time between falling edge of pulse signal $P_3$ and the rising edge of a next period of pulse signal $P_0$ is $t_3'$ Each of the pulse signals $P_0$ through $P_3$ are repeated every period T.

In one example, for a refresh rate of 90 Hz (i.e., a frequency of 90 Hz), the period T is about 11.1 ms. That is, $t_0+t'_0+t_1+t'_1+t_2+t'_2+t_3+t'_3=11.1$ ms. For a max PWM on/off ratio of 1:20, the maximum on time within the 11 ms window is 555.6 μs. That is, $t_0+t_1+t_2+t_3=555.6$ μs. As such, to is approximately 37 μs. As such, $t_1$ is approximately 74.1 μs, $t_2$ is approximately 0.148 ms, and $t_3$ is approximately 0.296 ms. In the embodiments where the brightness depth is different than 4 bits, $t_0$ may be calculate as:

$$t_0 = \frac{1}{\text{refresh_rate}} \times (\text{PWM_ratio}) \times \frac{1}{2^n - 1}$$

where refresh_rate is the refresh rate of the display panel (e.g., 90 Hz), PWM_ratio is the max PWM on/off ratio (e.g., 1:20), and n is the brightness depth of the mLED cell (e.g., 8 for 8-bit brightness signals).

In some embodiments, times $t_0'$, $t_1'$ $t_2'$, and $t_3'$ have the same length. In other embodiments, time $t_0'$ is proportional to time $t_0$, time $t_1'$ is proportional to time $t_1$, time $t_2'$ is proportional to time $t_2$, and time $t_3'$ is proportional to time $t_3$. This may account for a longer cool down time of the mLED due to a longer on time of the pulse signals.

In some embodiments, pulses $P_0$ through $P_3$ are generated by a chain of D-type flip-flops, each flip-flop stage performing a clock division by 2 function. In another embodiment, the pulses $P_0$ through $P_3$ are generated using a look-up-table that contains 1 bit pulse shapes corresponding to the relevant times $t_n$ and $t_n'$. The look-up-table may be hardcoded or user programmed in a reprogrammable memory. In yet another embodiment, pulses $P_0$ through $P_3$ are generated using two clocks, one controlling the $t_n$ periods and the second the $t_n'$ periods. In this embodiment, the control switching between the clocks is based on the state of the output. That is, a first clock is in control when the output is low and a second clock is in control when the output is high.

Figure 4B:
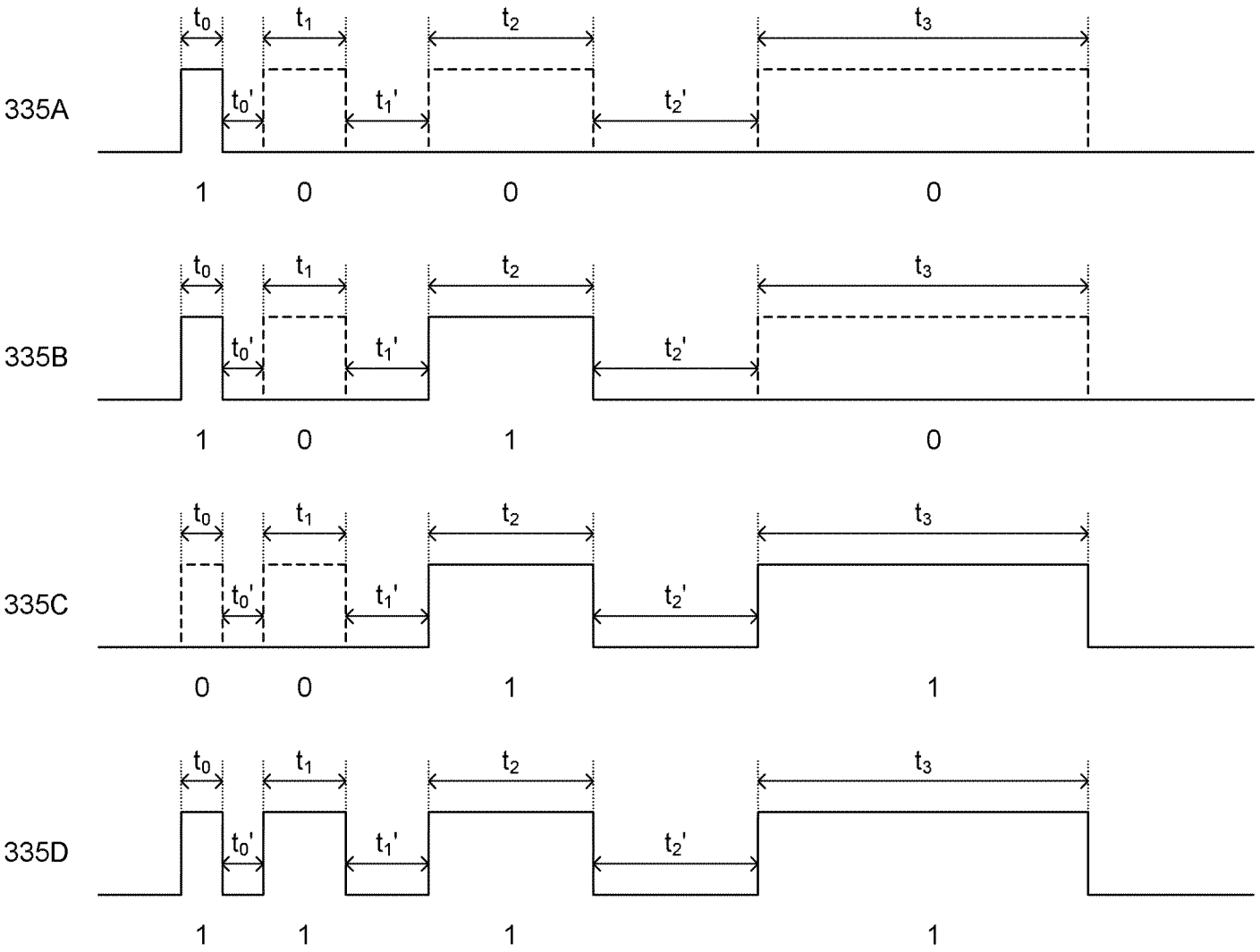
FIG. 4B illustrates a timing diagram of several PWM signals for different data inputs, according to one embodiment.

Referring back to FIG. 3A, the outputs of the AND gates 330 are combined to form digital PWM signal 335 and provided as an input to current source 340. FIG. 4B illustrates a timing diagram of several PWM signals for different data inputs, according to one embodiment. Digital PWM signal 335A corresponds to a data input of 0001. As such, digital PWM signal 335A is only in the ON state when pulse signal $P_0$ is active. Digital PWM signal 335B corresponds to a data input of 0101, and thus, is only in the ON state when pulse signals $P_0$ and $P_2$ are active. Digital PWM signal 335C corresponds to data input 1100, and thus, is only in the ON state when pulse signals $P_2$ and $P_3$ are active. Digital PWM signal 335D corresponds to data input 1111, and thus, is in the ON state when pulse signals $P_0$, $P_1$, $P_2$, and $P_3$ are active.

Referring back to FIG. 3A, the current source 340 generates a driving current signal based on the digital PWM signal and the driving current is provided to the mLED for driving the mLED. In some embodiments, the current source 340 includes a transistor that turns on and off based on the digital PWM signal. That is, the transistor of the current source 340 conducts current from a supply voltage when the digital PWM signal is in the ON state and blocks current from passing when the digital PWM signal is in the OFF state.

Figure 5:
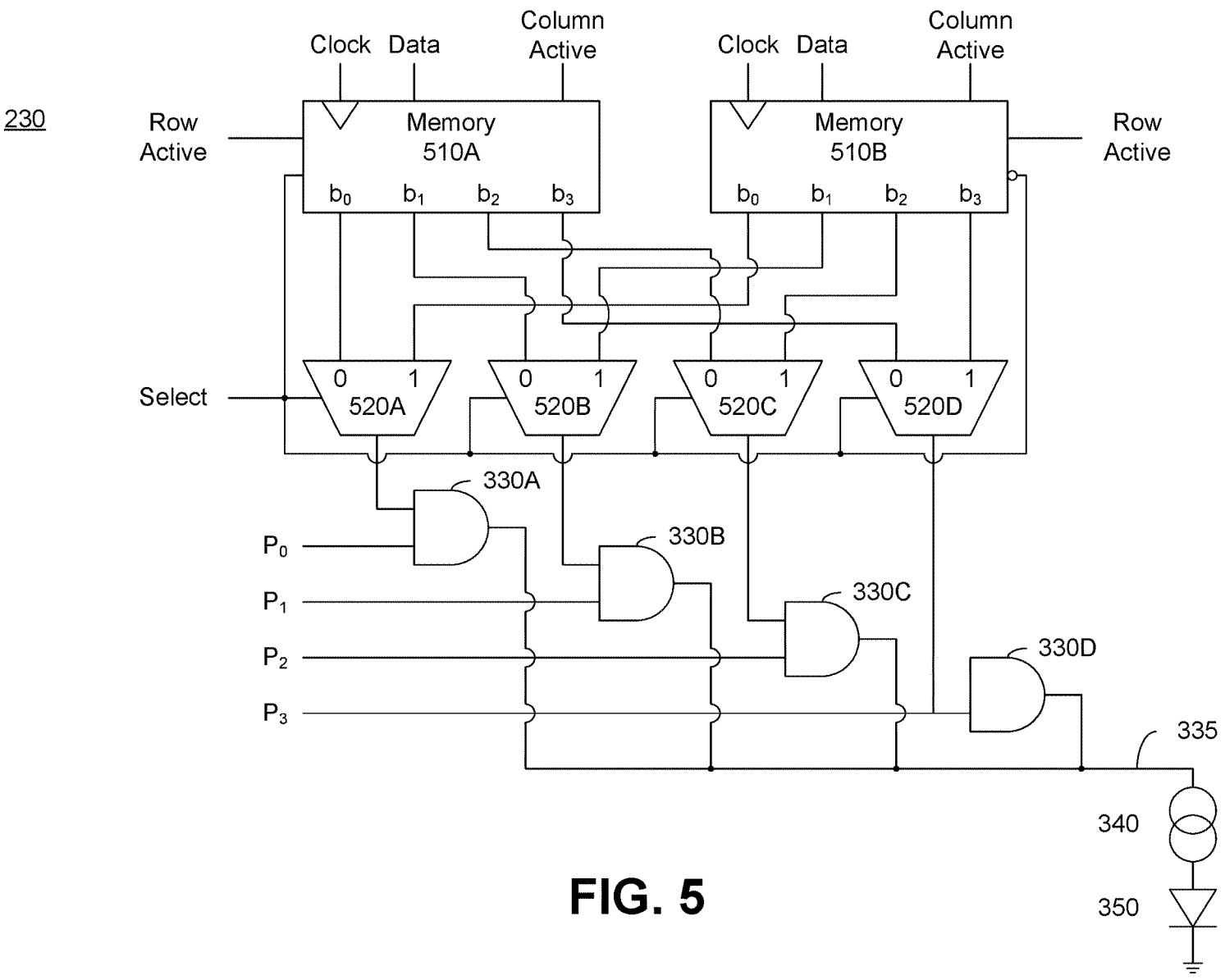
FIG. 5 illustrates a circuit diagram of a mLED cell including multiple memories, according to one embodiment.

FIG. 5 illustrates a circuit diagram of a mLED cell 230 including multiple memories, according to one embodiment. The mLED cell 230 of FIG. 5 includes two memories 510A and 510B and multiple multiplexers 520 instead of memory 320. Memory 510A may output a brightness data signal to AND gates 330 while data is being written to memory 510B. Similarly, memory 510B may output a brightness data signal to AND gates 330 while data is being written to memory 510A. The brightness data signal is selected using multiplexers 520A through 520D based on a value of the select signal. For instance, if select signal is 0 or LO, multiplexer 520A propagates output $b_0$ of memory 510A to AND gate 330A, multiplexer 520B propagates output $b_1$ of memory 510A to AND gate 330B, multiplexer 520C propagates output $b_2$ of memory 510A to AND gate 330C, and multiplexer 520D propagates output $b_3$ of memory 510A to AND gate 330D. If select signal is 1 or HI, multiplexer 520A propagates output $b_0$ of memory 510B to AND gate 330A, multiplexer 520B propagates output $b_1$ of memory 510B to AND gate 330B, multiplexer 520C propagates output $b_2$ of memory 510B to AND gate 330C, and multiplexer 520D propagates output $b_3$ of memory 510B to AND gate 330D. Furthermore, an enable signal value of 0 or LO selects memory 510B for writing and an enable signal value of 1 or HI selects memory 510A for writing.

Figure 6:
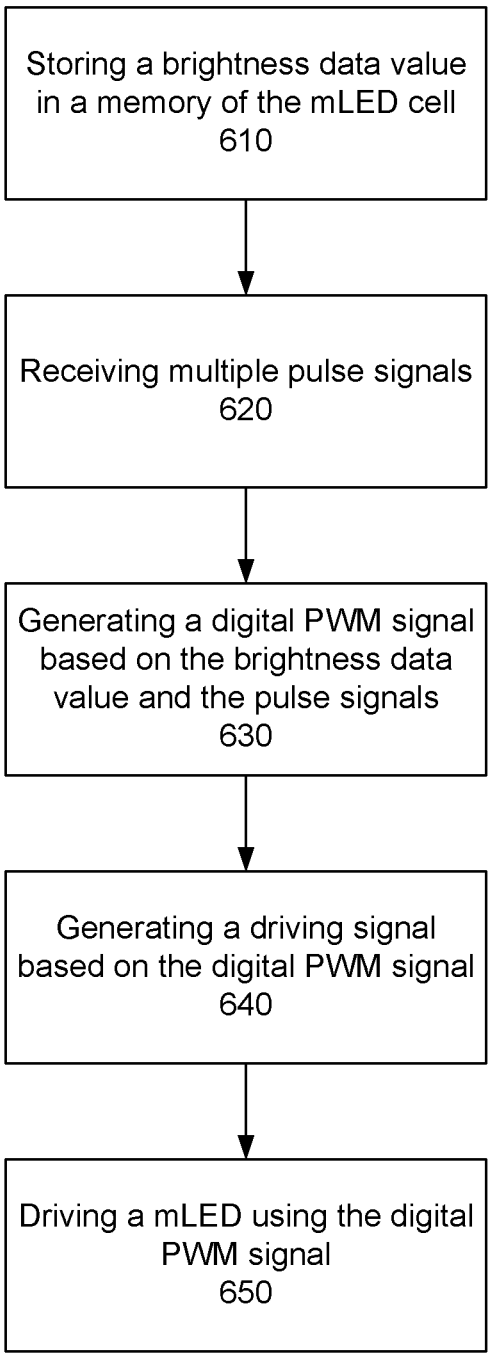
FIG. 6 illustrates a flow diagram of a method for operating a mLED cell, according to one embodiment.

FIG. 6 illustrates a flow diagram of a method for operating a mLED cell, according to one embodiment. The mLED cell 230 receives a brightness data value and stores 610 the brightness data value in memory 320. In some embodiments, the brightness data value is received and stored serially. In other embodiments, the brightness data value is received and stored in parallel. The mLED cell 230 further receives 620 multiple pulse signals. The mLED cell 230 generates 630 a digital PWM signal based on the brightness data value and the multiple pulse signals. The digital PWM is generated by ANDing each bit of the brightness data value with a pulse signal of the multiple received pulse signals.

A driving signal is generated based on the digital PWM signal. In some embodiments, the driving signal is generated by a current source that generates a driving current based on the digital PWM signal. A mLED is driven based on the generated driving signal. The mLED then emits light with an average brightness that is proportional to the brightness data value.

Upon reading this disclosure, those of ordinary skill in the art will appreciate still additional alternative structural and functional designs through the disclosed principles of the embodiments. Thus, while particular embodiments and applications have been illustrated and described, it is to be understood that the embodiments are not limited to the precise construction and components disclosed herein and that various modifications, changes and variations which will be apparent to those skilled in the art may be made in the arrangement, operation and details of the method and apparatus disclosed herein without departing from the spirit and scope as defined in the appended claims.

What is claimed is:

1. A micro-light-emitting-diode (mLED) display device comprising:

an mLED configured to emit light;

a controller receiving a brightness data signal and generating a driving signal corresponding to the brightness data signal, the controller coupled to the mLED for providing the driving signal that turns on the mLED for first times and turns off the mLED for second times for a duration of a cycle; and a current source coupled between an output of the controller and the mLED to generate a driving current based on the driving signal, the driving current causing a current density in the mLED to be above a threshold value of 1 $A/cm^2$ when the mLED is turned on.

2. The mLED display device of claim 1, wherein the current source comprises a transistor that is configured to turned on and off based on the output of the controller.

3. The mLED display device of claim 1, wherein the controller comprises:

a memory including a plurality of memory cells, the memory further including a plurality of memory outputs, each memory output corresponding to an output of a memory cell, the memory storing the brightness data signal; and a plurality of gates, each gate of the plurality of gates comprising:

a first input node coupled to a memory output of the plurality of memory outputs, a second input node coupled to a periodic pulse signal of a plurality of periodic pulse signals, and an output node, the output node configured to output a signal having a high level when the memory output and the periodic pulse signal have a level higher than a threshold value, and output a signal having a low level when the memory output or the periodic pulse signal have a level lower than the threshold value.

4. The mLED display device of claim 3, wherein a number of memory cells of the memory is equal to a bit depth of the brightness data signal.

5. The mLED display device of claim 3, wherein the controller further comprises:

a second memory including a plurality of memory cells, the second memory cell further including a plurality second of memory outputs, each output of the plurality of second memory outputs corresponding to an output of a second memory cell; and a plurality of multiplexers; each multiplexer of the plurality of multiplexers coupled to a memory output and a second memory output;

wherein each of the plurality of gates is coupled to a multiplexer of the plurality of multiplexers.

6. The mLED display device of claim 5, wherein:

the first memory is enabled for writing when the plurality of multiplexers are configured to select the output of the second memory, and the second memory is enabled for writing when the plurality of multiplexers are configured to select the output of the memory.

7. The mLED display device of claim 3 wherein the plurality of gates comprises:

a first gate coupled to a first output of the memory and a first periodic pulse signal; and a second gate coupled to a second output of the memory and a second periodic pulse signal;

wherein the second periodic pulse signal has a pulse duration that is twice as long as a pulse duration of the first periodic pulse signal.

8. The mLED display device of claim 7, wherein a pulse of the second periodic pulse signal starts after an end of a pulse of the first periodic pulse signal.

9. The mLED display device of claim 7, wherein a pulse width of the first periodic pulse signal is inversely proportional to a refresh rate of the mLED cell and a bit-depth of the brightness data signal.

10. The mLED display device of claim of claim 7, further comprising:

a third AND gate coupled to a third output of the memory and a third periodic pulse signal, wherein the third periodic pulse signal has a pulse duration that is twice as long as the pulse duration of the second pulse signal.

11. A micro-light-emitting-diode (mLED) driver circuit comprising:

a memory including a plurality of memory cells, the memory further including a plurality of memory outputs, each memory output corresponding to an output of a memory cell, the memory storing a value of a brightness data signal; and a plurality of gates, each gate of the plurality of comprising:

a first input node coupled to a memory output of the plurality of memory outputs, a second input node coupled to a periodic pulse signal of a plurality of periodic pulse signals, and an output node, the output node configured to output a signal having a high level when the memory output and the periodic pulse signal have a level larger than a threshold value, and output a signal having a low level when the memory output or the periodic pulse signal have a level smaller than the threshold value; and a current source, the current source coupled to an output of each of the gates, the current source generating a driving current within a frame based on the outputs of each of the gates, an average amplitude of the driving current based on the brightness data value, the driving current causing a current density in an mLED to be above a current density threshold value of 1 A/cm' when the mLED is turned on.

12. The mLED driver circuit of claim 11, further comprising:

a second memory including a plurality of memory cells, the second memory cell further including a plurality second of memory outputs, each output of the plurality of second memory outputs corresponding to an output of a second memory cell; and a plurality of multiplexers; each multiplexer of the plurality of multiplexers coupled to a memory output and a second memory output;

wherein each of the plurality of gates is coupled to a multiplexer of the plurality of multiplexers.

13. The mLED driver circuit of claim 11 wherein the plurality of gates comprises:

a first gate coupled to a first output of the memory and a first periodic pulse signal; and a second gate coupled to a second output of the memory and a second periodic pulse signal;

wherein the second periodic pulse signal has a pulse duration that is twice as long as a pulse duration of the first periodic pulse signal.

14. The mLED driver circuit of claim 13, wherein a pulse of the second periodic pulse signal starts after an end of a pulse of the first periodic pulse signal.

15. The mLED driver circuit of claim 13, wherein a pulse width of the first periodic pulse signal is inversely proportional to a refresh rate of the mLED driver circuit and a bit-depth of the brightness data signal.

16. A method for operating a micro-light-emitting-diode (mLED), comprising:

generating a driving signal corresponding to a brightness data signal;

generating, by a current source, a driving current based on the driving signal;

turning on the mLED for first times in a duration of a cycle by the driving current to cause a current density in mLED to be above a threshold value of 1 $A/cm^2$; and turning off the mLED for second times in the duration of the cycle by the driving current.

17. The method of claim 16, wherein generating the driving signal comprises:

storing the brightness data value in a memory cell of an mLED cell, the brightness data value indicative of a desired brightness for the mLED;

receiving multiple periodic pulse signals, the multiple periodic pulse signals including:

a first periodic pulse signal, and a second periodic pulse signal, the second pulse signal having a pulse width that is double a pulse width of the first periodic pulse signal;

generating a digital pulse-width-modulation (PWM) signal by ANDing each bit of the brightness data value with a pulse signal of the multiple periodic pulse signals;

generating a driving signal based on the digital PWM signal; and driving the mLED of the mLED cell using the generated driving signal.

18. The method of claim 17, wherein generating the digital PWM signal comprises:

ANDing the first periodic pulse signal with a least significant bit of the brightness data value; and ANDing the periodic second pulse signal with a second least significant bit of the brightness data value.

* * * * *